US005531385A

United States Patent [19]

Witsken

[11] Patent Number: 5,531,385

[45] Date of Patent: Jul. 2, 1996

[54] APPARATUS AND METHODS FOR WET GRINDING

[76] Inventor: Anthony Witsken, 4415 School Section Rd., Cincinnati, Ohio 45211

[21] Appl. No.: 58,410

[22] Filed: May 7, 1993

[51] Int. Cl.[6] ..... B02C 7/12

[52] U.S. Cl. ..... 241/21; 241/46.06; 241/261.3

[58] Field of Search ..... 241/21, 46.06, 241/261.2, 261.3

[56] References Cited

U.S. PATENT DOCUMENTS

| | | | |
|---|---|---|---|
| Re. 30,011 | 5/1979 | Seifert | 241/46.06 |
| 254,814 | 3/1882 | Gathmann | 241/261.3 |
| 2,064,666 | 12/1936 | Krushel . | |
| 2,101,442 | 12/1937 | Martinez . | |
| 3,214,104 | 10/1965 | Breuninger et al. | 241/261.2 |
| 3,568,940 | 3/1971 | Merges | 241/47 |
| 3,827,644 | 8/1974 | Johansson | 241/259.3 |
| 4,036,443 | 7/1977 | Saltarelli | 241/297 |
| 4,039,153 | 8/1977 | Hoffman | 241/248 |
| 4,081,146 | 3/1978 | Yagi | 241/259.3 X |
| 4,082,233 | 4/1978 | Reinhall | 241/244 |
| 4,129,263 | 12/1978 | Sjöbom | 241/248 |
| 4,201,349 | 5/1980 | Walsh | 241/247 |
| 4,253,613 | 3/1981 | Reinhall | 241/16 |
| 4,269,365 | 5/1981 | Berggren | 241/261.2 X |
| 4,351,489 | 9/1982 | Laptev et al. | 241/261.3 |
| 4,684,070 | 8/1987 | Dicky | 241/79.3 |
| 4,684,071 | 8/1987 | Dicky | 241/80 |
| 4,819,881 | 4/1989 | Sepke | 241/88.1 |
| 4,927,088 | 5/1990 | Brewer | 241/223 |
| 5,195,684 | 3/1993 | Radzins | 241/57 |

FOREIGN PATENT DOCUMENTS

| | | | |
|---|---|---|---|
| 3535245 | 4/1987 | Germany | 241/261.3 |

*Primary Examiner*—John Husar
*Attorney, Agent, or Firm*—Wood, Herron & Evans

[57] ABSTRACT

Wet grinding apparatus including a grinding unit having first and second outer plates forming a housing with an inner chamber. A rotatable disc is housed in the inner chamber. A drive shaft is attached to the rotatable disc and extends centrally through one side of the housing. The other side of the housing includes a central inlet port for allowing introduction of slurry solution. A peripheral edge surface of the housing includes one or more outlet ports. Inner surfaces of the first and second outer plates and both surfaces of the rotatable disc have a series of outwardly extending grooves which taper in depth from a central location of each disc to a peripheral portion of each disc. The rotatable disc further includes a plurality of central feed ports or openings in communication with grooves on each side of the rotatable disc. The grinding method and operation of the apparatus include feeding slurry solution containing particles into the grooves and rotating the rotatable disc to reduce the size of the particles in the slurry solution while transferring the slurry solution to the outlet or outlets of the grinding unit.

33 Claims, 3 Drawing Sheets

APPARATUS AND METHODS FOR WET GRINDING

BACKGROUND OF THE INVENTION

The present invention generally relates to apparatus for wet grinding and, more particularly, to the grinding of particles in a slurry solution down to particles having a size on the order of several microns or less.

Generally, size reduction of particles in a slurry is accomplished in multistage processes. That is, large particles of grain such as whole grain, corn, rice and the like, or other solids are initially broken down in size by conventional milling apparatus such as roll crushers, hammer mills, shredders and other similar devices depending on the product being ground. As one example, hammer mills may be suitable for use in dry grinding processes, wet grinding processes or both and may include a rotating cylinder or drum with attached "hammers" which crush particles against a stator screen. Hammer mills generally work under the principle of forcing particles through the holes in the stator screen to produce particles of a size commensurate with the size of the screen holes. Hammer mills are used in the distilling industry to dry grind grain which is later slurried with water in a separate tank to prepare the grain for fermentation. Disadvantages of hammer mills include the possibility of explosions resulting from the production of large amounts of dust, high maintenance costs associated with regular replacement of stator screens, and loss of product and damage to product from heat produced during the grinding process.

U.S. Pat. No. 4,813,617 ('617) issued on Mar. 21, 1989 to Knox, Jr. et al., which names the present inventor as a co-inventor thereof, addresses the problem of obtaining both maximum grinding efficiency and maximum throughput volume in a wet grinding machine. The '617 patent provides apparatus for very efficiently grinding large particles such as corn and the like down to smaller particles, for example, on the order of ⅛" in diameter, on a continuous high throughput volume basis. The '617 patent successfully accomplishes this objective by combining both large and small slots in a stationary stator and using a rotating bladed rotor disposed within the stator. Larger particles are reduced in size through shearing action between the blades of the rotor and the edges of the large slots in the stator and smaller particles are reduced in size through shearing action between the rotor blades and the small slots in the stator. Large particles are transferred out of the stator through the large slots and small particles are transferred out of the stator through both the large and small slots. The apparatus disclosed in the '617 patent presents a significant improvement over past grinding methods in terms of the size reduction and throughput volume potential of a single step grinding apparatus capable of reducing relatively large particles down to particles having an average diameter, for example, of ⅛".

Regarding apparatus and methods for reducing particles from a size on the order of ⅛" to a size of several microns or less, ball mills, hammer mills and homogenizers have been used in the past. Apparatus of this type have several undesirable features and cost implications. First, in order to obtain smaller and smaller particle sizes the holes in the stator screen or, for example, the balls or beads of a ball mill must be smaller to obtain smaller particle sizes. As the screen holes, balls or beads get smaller so to does the throughput volume of the grinding apparatus using these grinding or size reduction means. Thus, past fine grinding methods produce very low volumes of finely ground product.

Also, the costs associated with the manufacture, operation and maintenance of these machines is very high. For example, the costs associated with manufacturing minute openings in the screens used in a hammer mill are high especially when considering that the screens must be replaced constantly. The costs of manufacturing and maintaining a typical homogenizer are high due to the costs of the high pressure pumps, high powered motors and many other precision components.

Other problems have arisen using past methods to produce particle sizes on the order of several microns or less such as the undesirably long milling times, which may stretch up to 30 hours and which add to the costs of using ball mills, hammer mills and homogenizers. In the case of ball mills, due to the long milling time involved, these mills must be surrounded by cooling jackets which further add to their cost and complexity.

Accordingly, there is a need in the art for apparatus and methods for reducing the size of particles from sizes easily produced by apparatus such as that shown in the '617 patent, down to sizes on the order of several microns or less in a fast and efficient manner by producing continuous high throughput volumes of dispersions and emulsifications containing such particles.

It has therefore been one objective of the invention to provide a wet fine grinder capable of continuously grinding particles contained in a slurry solution without clogging and without significant wear on the size reducing or grinding components of the apparatus.

It has been another objective of the invention to produce high throughput volumes of particles of a size on the order of several microns or less quickly and efficiently on a continuous in-line basis as opposed to a single batch basis.

It has been still another objective of the invention to significantly reduce the amount of time and number of grinding steps necessary to reduce large amounts of slurry solution containing relatively large particles into a slurry solution containing particles of several microns or less in size.

It has been yet another objective of the invention to provide apparatus for grinding particles in a batch of slurry contained in a tank as well as apparatus for grinding particles contained in slurry solution traveling in a fluid line and continuously recirculating slurry solution through each grinding apparatus.

It has been still a further objective of the invention to use the slurry solution itself as a lubricant and a coolant for the grinding components of the apparatus to substantially reduce wear on grinding components of the apparatus.

SUMMARY OF THE INVENTION

To these ends, the present invention provides at least two plates or discs having opposed flat surfaces and a plurality of outwardly extending grooves in each flat surface for containing and grinding particles in a slurry solution. At least one of the discs is rotated at high speed with respect to the other of the discs to facilitate size reduction of particles located in opposed grooves of different discs. The slurry preferably enters the spaces created by the grooves at a central inlet of one or more of the discs and is transferred to the periphery of the discs by centrifugal force created through rotation of at least one of the discs. The slurry is then preferably recirculated to the central inlet to continuously circulate the slurry through the slots in the discs. In the preferred embodiments, the slots in the discs are tapered in depth along their length such that their deepest points are proximate the central inlet of the discs and their most shallow points are proximate the periphery of the discs. Furthermore, the grooves in each disc preferably end short of the periphery of the disc.

More particularly, a first preferred embodiment of the invention comprises an in-line grinding unit which includes a housing formed by two outer plates or discs. One of these outer discs includes an elevated land having a major face. A plurality of equally spaced grooves extend radially outwardly from a central slurry inlet port in the disc to a point proximate the outer periphery of the raised land.

A rotatable plate or disc includes similar grooves on both of its major faces and has a central threaded bore which allows the disc to be mounted to a rotatable drive shaft. This rotatable disc further includes feed openings spaced around and proximate to the central threaded bore. These feed openings extend through the rotatable disc from the first major face thereof to the second major face thereof and each feed opening communicates with an inlet end of one groove on the first major face and the inlet end of one groove on the second major face, The second outer plate or disc forms a housing with the first outer plate or disc by including a flange portion which extends at right angles to the outer plates or discs and is attached to the first outer plate or disc radially outward of the raised land to form a chamber containing the rotatable disc. This chamber is substantially equal in height to the maximum thickness of the rotatable disc. The second outer plate or disc includes a central bore through which the drive shaft of a motor, for example, extends and further includes a plurality of radially spaced outwardly extending tapered grooves similar to the tapered grooves in both the first outer plate or disc and the rotatable plate or disc.

In this first preferred embodiment, the outer peripheral surface of the flange of the second outer plate or disc includes an outlet port through which ground slurry is transferred by way of centrifugal force created by the rotating disc within the chamber of the housing. The outer peripheral edge of the rotating disc includes notches which accumulate ground slurry and carry it around the outer edge of the rotating disc to the outlet port. This design provides a pumping action which effectively pumps the slurry out of the chamber in the housing to the outlet port such that it may then be recirculated to the central inlet port of the grinding unit or fed into a receiving tank.

The second preferred embodiment of the present invention is very similar to the first embodiment in that two discs form a housing which contains a rotatable disc and each of the discs include grooves which interact with one another to provide a disintegrating action as well as a transfer path from central portions of each disc to at least one outlet in the outer periphery of the housing. In the second preferred embodiment, the grinding apparatus is submerged in a tank of slurry containing particles and the slurry is initially forced into the central inlet port by atmospheric pressure acting on the top surface of the slurry solution in the tank. The slurry solution that contains the particles is then drawn into and transferred along the grooves of each disc as a result of centrifugal forces created by the rotating disc. The particles in the slurry are disintegrated between the rotating disc and the discs which form the housing before the slurry exits through peripheral outlets in the housing. The slurry is thereby constantly recirculated from the tank into the central inlet port of the grinding unit, through the grooves in each of the discs, and back into the tank.

Each of the above described embodiments work on similar principles. That is, as the slurry material advances radially outwardly along the grooves, the particles are repeatedly reduced in size by shearing action between the advanced edge of one of the housing plates and the trailing edge of a groove in the rotating disc. Moreover, particles constantly collide with one another and are subjected to fluctuating pressures within the intermittently registering grooves of adjacent discs to cause further disintegration of the particles as they travel outwardly within the grooves. In addition, particles caught between the flat surfaces of the discs are reduced in size through a rolling action of the particles between the flat surfaces. If the particles are fibrous, then the fibers making up the particles are rolled into and compacted against each other to reduce the sizes of the particles.

As the particles are reduced in size, they travel radially outwardly along the grooves into shallower and shallower portions of the grooves and are finally reduced to sizes which are generally less than the distance between first and second flat surfaces of the rotating disc and the respective opposed flat surfaces of the outer housing plates or discs. After the particles have been ground, the slurry containing the particles exits the apparatus and may then be recirculated back to the inlet. In its preferred use, the invention is particularly applicable to the grinding of particles down to sizes of, for example, less than 5 microns. However, the apparatus may be dimensioned for grinding or disintegrating particles having greater diameters as well. This would merely require changing the depth of the grooves, the spacing between the rotating disc and the housing plates or discs, and other dimensions of the apparatus accordingly.

Further objects and advantages of the invention will become more readily apparent through the following detailed description taken in conjunction with the accompanying drawings.

DETAILED DESCRIPTION OF THE PREFERRED EMBODIMENTS

Figures 1, 2:
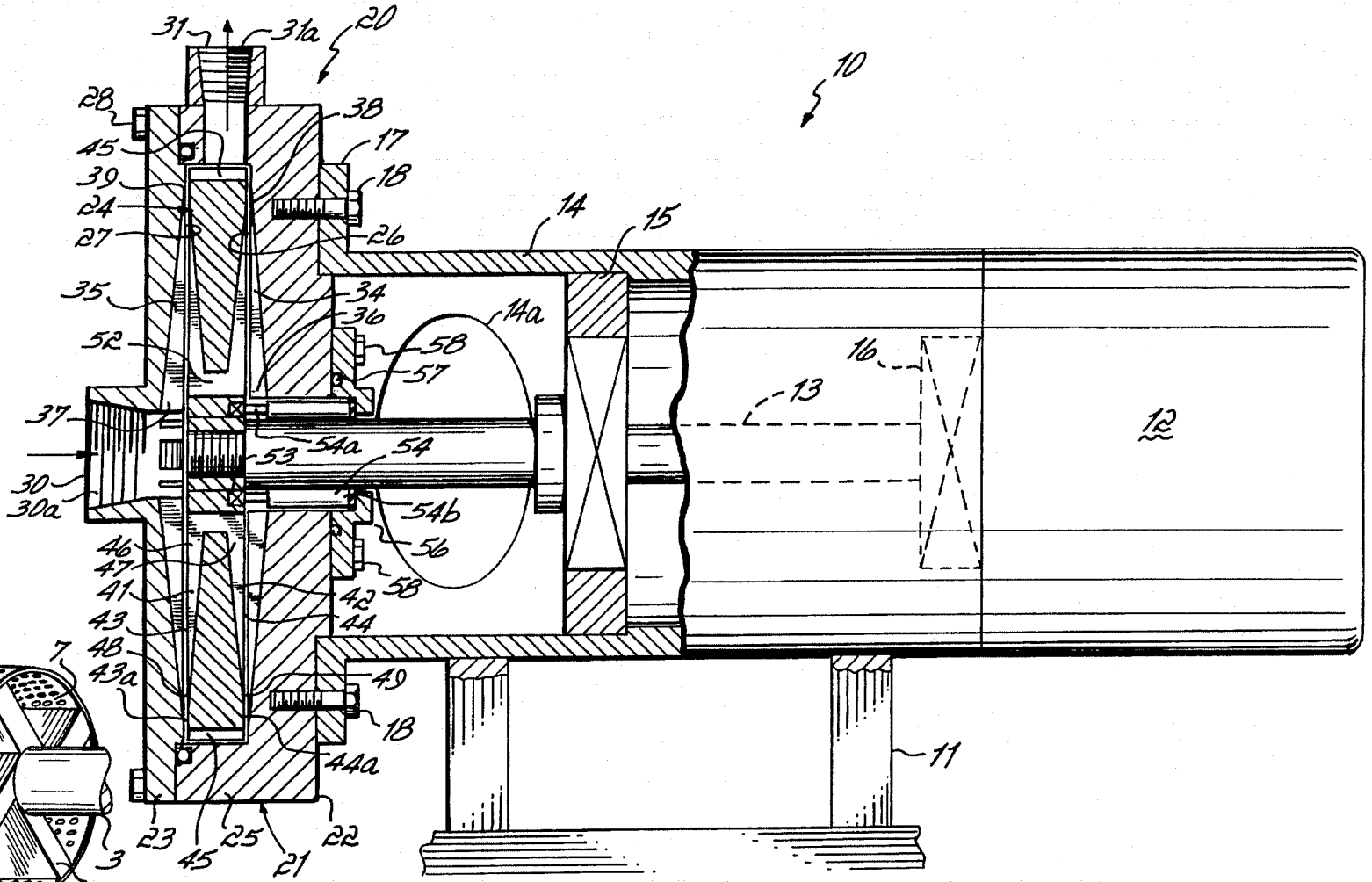
FIG. 2 PRIOR ART
FIG. 1 is a partially fragmented perspective view of a conventional wet grinder used on a batch volume basis for reducing the size of particles contained in a slurry.
FIG. 2 is a partially cross-sectional side view of a first embodiment of the present invention showing an in-line wet grinding apparatus.

Before describing the preferred embodiments of the present invention, reference is first made to FIG. 1 which illustrates a conventional wet grinder 1 which is used in a batch of slurry material to reduce the size of particles contained in the slurry material. The wet grinder 1 includes a plurality of baffles 2 radially extending from the lower end of a drive shaft 3 and rotatably received in a circular screen structure 4. The screen structure 4 is typically held between upper and lower flanges (not shown). In operation, the wet grinder 1 is lowered into a batch of slurry material and the drive shaft 3 is rotated to draw slurry material into an inlet end 5 of the screen structure 4 through the lower flange (not shown). Once the slurry material is drawn into the screen structure 4, part of the material is forced through the screen openings 6. Many larger particles may not be able to be forced through the openings 6 in the screen structure 4 by the baffles 2. Also, devices such as the one shown in FIG. 1 reduce particles to a size which is limited by the size of the holes 6 in the screen structure 4 and, although the holes 6 may be formed in very small sizes through processes such as photoetching, by doing so the screen structure 4 becomes very fragile and easily subject to deformation. Moreover, problems related to clogged screen holes 6 and low throughput volume of ground slurry material often arise with devices of this type.

A first preferred embodiment of the present invention is illustrated in FIG. 2 and comprises an in-line wet grinding apparatus 10 having a mounting base 11 and a drive means in the form of a motor 12 directly coupled to a drive shaft 13. The drive shaft 13 extends along the longitudinal axis of the apparatus 10 inside a drive shaft housing 14. The drive shaft housing 14 includes an access port 14*a* for allowing maintenance to be performed on components within the housing 14. The drive shaft 13 is supported by bearing assemblies 15, 16 contained in the drive shaft housing 14. A flange portion 17 of the drive shaft housing 14 is located at one end thereof opposite the motor 12 and is attached by bolts 18 to a grinding unit 20.

Figure 3:
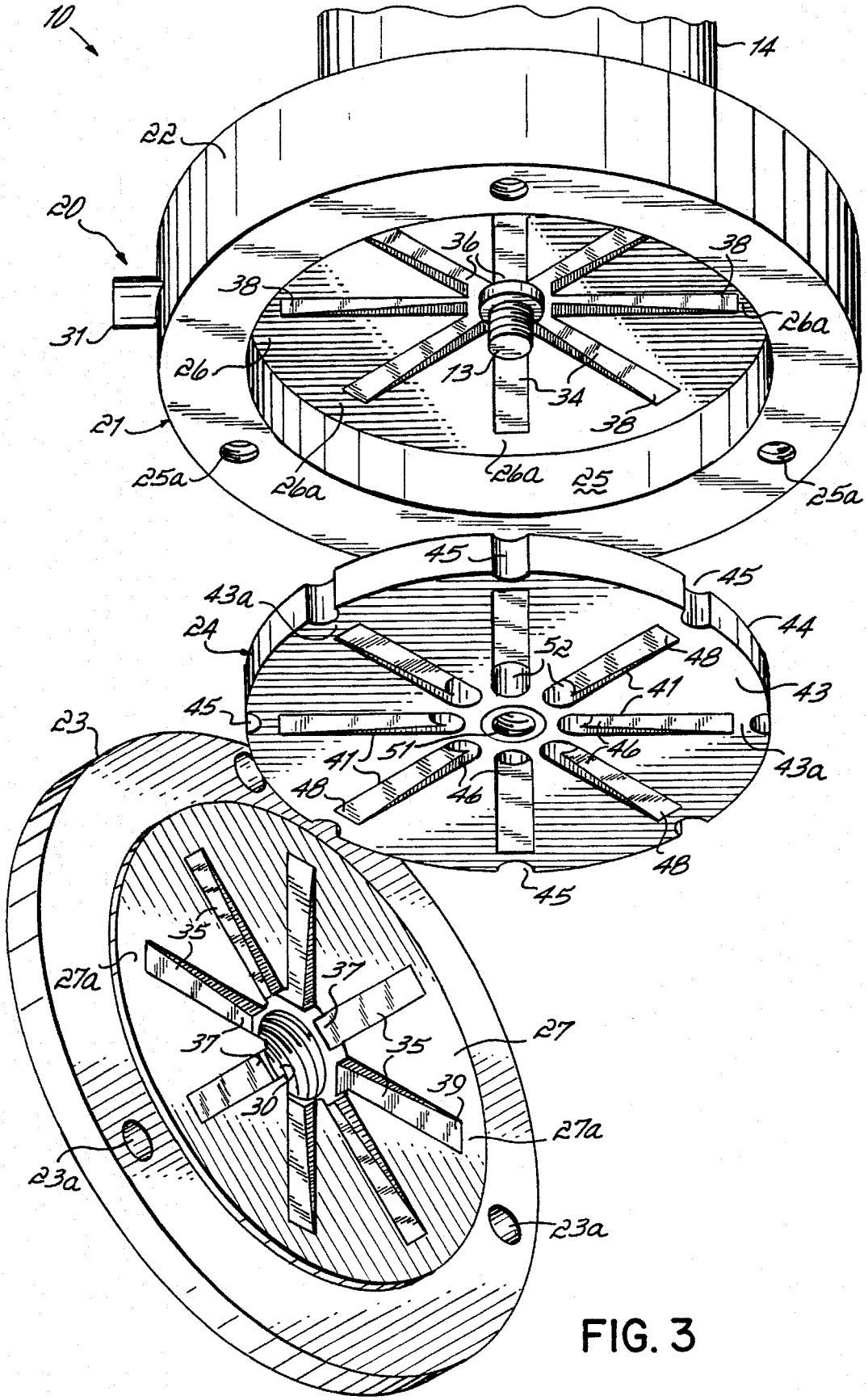
FIG. 3 is an exploded perspective view of the particle grinding or size reducing components of the apparatus shown in FIG. 2.

Referring now to both FIGS. 2 and 3, a preferred embodiment of the grinding unit 20 includes a grinding unit housing 21 having outer discs 22, 23 which together form an inner chamber which receives an inner rotary disc 24. One of the outer discs 22 includes a flange portion 25 which is connected to the other outer disc 23 by bolts 28 received in apertures 23*a* of disc 23 and threaded holes 25*a* in flange portion 25. The grinding unit housing 21 further includes a slurry inlet 30 and a slurry outlet 31. The slurry inlet 30 preferably extends through the center of disc 23 and the slurry outlet 31 extends through the flange portion 25 of disc 22. The slurry inlet 30 and slurry outlet 31 may vary in size according to the flow requirements of the particular grinding operation. The slurry inlet 30 and slurry outlet 31 have respective female threaded portions 30*a*, 31*a* for connecting fittings and fluid lines thereto. Of course, male threaded portions or other connecting means, such as quick-connect fittings, may be substituted for the female threads shown.

As previously mentioned, the outer discs 22, 23 preferably form a housing or stator within which the inner rotary disc 24 rotates. The inner surfaces 26, 27 of each respective outer disc 22, 23 contain a series of grooves 34, 35. As shown best in FIG. 2, each groove 34, 35 preferably tapers in depth from a respective inlet end 36, 37 to a respective outlet end 38, 39. Each of the grooves 34, 35 are deeper at their respective inlet ends 36, 37 than at their respective outlet ends 38, 39. The inlet ends 37 of each of the grooves 35 in disc 23 communicate with the slurry inlet 30 at the center of disc 23.

As further shown in FIG. 2, the rotary disc 24 includes a series of tapered grooves 41, 42 in both of its major faces 43, 44. The grooves 41, 42 extend from respective inlet ends 46, 47 to respective outlet ends 48, 49. Notches 45 are formed in the peripheral edge surface of the rotary disc 24 and each notch 45 is in line with the outlet ends 48, 49 of two parallel grooves 41, 42 in opposite sides 42, 43 of the rotary disc 24. Like the grooves 34, 35 in discs 22 and 23, the grooves 41, 42 are each preferably tapered such that they are deeper at their respective inlet ends 46, 47 than at their respective outlet ends 48, 49.

A central threaded aperture 51 of disc 24 allows a threaded end of the drive shaft 13 to be attached to the rotary disc 24. The drive shaft 13 preferably rotates the inner disc 24 at a speed which is preferably in excess of 1000 rpm and may be, for example, 3450 rpm in a direct couple system between the motor 12 and the drive shaft 13. Of course, the actual speed will depend on the viscosity of the liquid containing the particles and/or the overall viscosity of the slurry solution. An annular pattern of spaced feed openings 52 are formed about the periphery of the drive shaft mounting aperture 51. Each feed opening 52 communicates with one inlet end 46 of a groove 41 on one side of the rotary disc 24 and one inlet end 47 of a groove 42 on the other side of the rotary disc 24. These feed openings 52 allow slurry solution to be introduced into the inlet 30 of disc 23 and fed from the grooves 35 in disc 23 into the grooves 42 in the rotary disc 24 which face away from the inlet 30 as well as the grooves 34 in disc 22.

A mechanical liquid seal is provided to keep the slurry solution within the grinding unit 20 and includes a rotary seal member 53 which is preferably formed of a ceramic material. The rotary seal member 53 is recessed into and rigidly attached to the rotary disc 24 intermediate the central drive shaft opening 51 and the spaced feed openings 52. A second spring loaded seal component 54 is held against the rotary component 53 by a mounting bracket 56 having an O-ring 57 in a lower surface thereof. The bracket 56 is fastened to outer disc 22 by a plurality of bolts 58. Thus, liquid seals are created between the rotary seal member 53 and the lower portion 54*a* of the spring loaded seal component 54, between the top portion 54*b* of the spring loaded seal component 54 and the bracket 56, and between the O-ring 57 and the outer surface of disc 22. One suitable seal assembly is marketed by Garlock Mechanical Packing Division, Mechanical Seals, a division of Colt Industries, under PK Form No. 70–20B.

Figure 4:
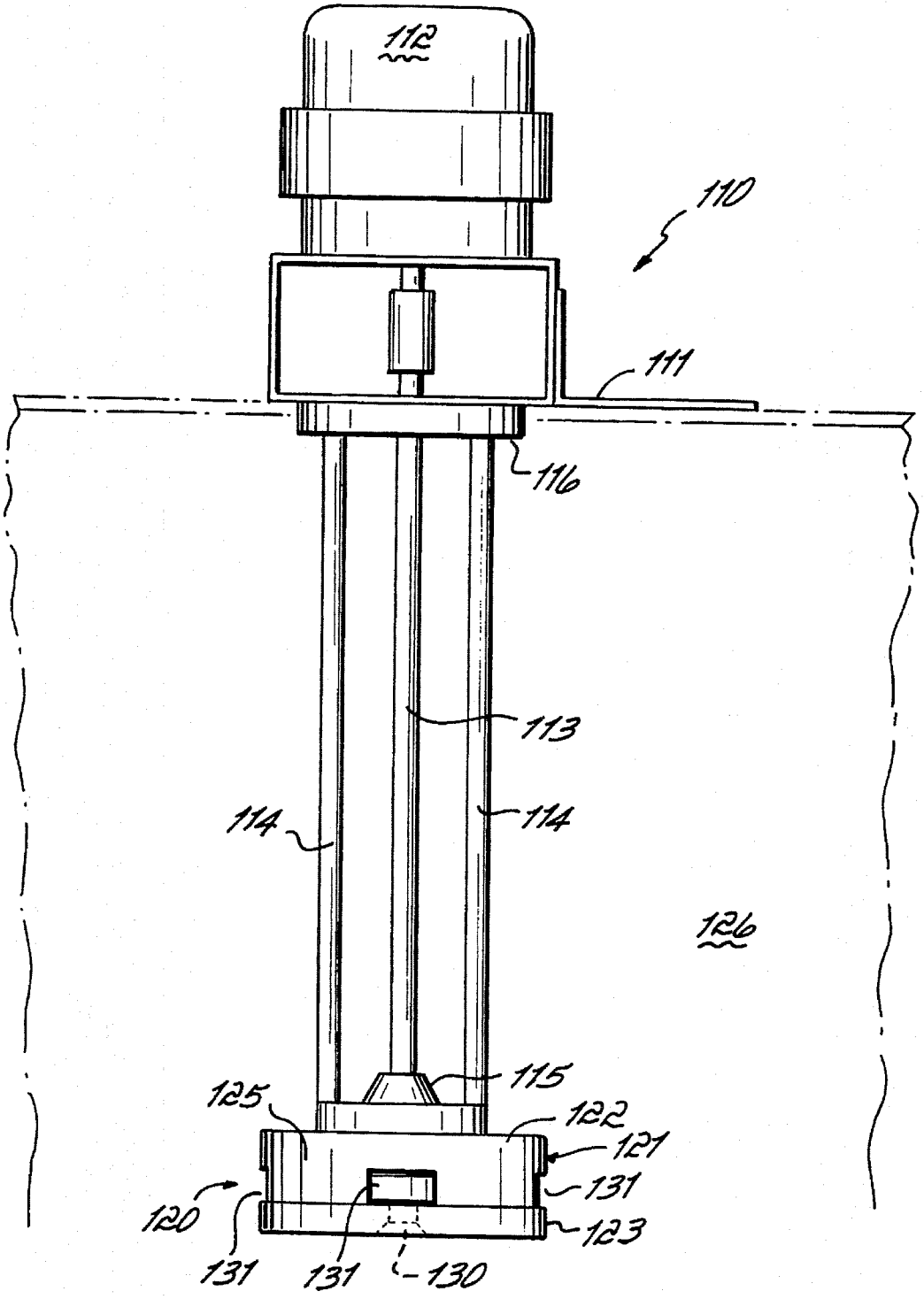
FIG. 4 is an elevated side view of a second embodiment of the present invention showing an in tank wet grinding apparatus.

A second embodiment of the invention is shown in FIG. 4 and comprises an in-tank grinding apparatus 110 mounted by a suitable bracket 111 to a tank of slurry solution 126. The grinding apparatus 110 includes a motor 112 at an upper end thereof operatively connected to a rotating drive shaft 113. Like the drive shaft 13 of the first embodiment, the drive shaft 113 is supported by suitable bearing assemblies 115, 116. At the lower end of the drive shaft 113, the grinding apparatus 110 includes a grinding unit 120 formed by a housing having outer plates or discs 122, 123.

There are only two significant differences between the in-line design shown in FIGS. 2 and 3 and the in-tank design shown in FIG. 4. One difference is that the in-tank grinding apparatus 110 includes elongated support rods 114 in place of a drive shaft housing. These elongated support rods 114 extend substantially between the motor 112 and the grinding unit 120 and are sized according to the depth of the tank in which the grinding apparatus is intended to be used. Thus, the drive shaft 113 and the support rods 114 are of a length which allows the motor 112 to be positioned above the top surface of the slurry material 126 and the grinding unit 120 to be positioned near the bottom of the tank of slurry solution.

The other difference between the two embodiments resides in the fact that a plurality of outlet ports 131 are formed in the flange portion 125 of disc 122 as opposed to a single outlet port. The use of a plurality of outlet ports 131 allows ground slurry to exit the grinding unit 120 in greater volumes than would a single outlet port. This allows slurry to be more quickly recirculated back to the inlet port 130 of the grinding unit 120 and further increases the volume of slurry moving through the grinding unit 120. Except for the use of a plurality of outlets 131, the inner design of the grinding unit 120 including the grooves (not shown)in the inner faces of the outer discs 122, 123 and the design of the grooved rotary disc (not shown), is identical to the design of the like components in the grinding unit 20 including discs 22, 23 and 24 shown in FIGS. 2 and 3 and described in detail above, This detail therefore need not be repeated in the description of the second embodiment.

In operating the embodiments shown in FIGS. 2 and 3 of the present invention, and with specific reference to FIG. 2, slurry solution containing particles enters the grinding unit 20 through the inlet port 30 by way of a fluid line (not shown) connected to the inlet port 30. The slurry solution is then drawn into the grooves 35 of disc 23 by the partial vacuum or negative pressure created by centrifugal forces of the rotating disc 24. The slurry solution also enters the feed apertures 52 in the rotating disc 24 and thereby reaches the series of grooves 42 in the rotating disc 24 as well as the series of grooves 34 in disc 22. The maximum initial size of the particles in the slurry solution entering the grinding unit 20 is limited by the maximum combined depth of a groove in disc 23 and a groove 41 in the rotary disc 24 added to the distance between faces 27, 43 of discs 23, 24, respectively. Likewise, the maximum initial particle size is also limited to the maximum combined depth of a groove 34 in disc 22 and a groove 42 in the rotary disc 24 added to the distance between faces 26, 44 of discs 22, 24, respectively. The feed openings 52 are also formed large enough to allow transfer of the maximum size of particles as defined above to prevent blockage of the feeding openings 52 by oversized particles. As shown in FIG. 3, feed apertures 52 are formed with a diameter which is not appreciably greater than a maximum width of tapered grooves 41 to which feed apertures open at the inlet ends 46 thereof. More specifically, apertures 52 are formed with a diameter which is approximately equal to a maximum width of tapered grooves 41 at inlet end 46. The slurry solution is preferably run through a classifier prior to entering the grinding unit 20 in order to filter out particles larger than the maximum initial size which may be effectively processed by the grinding unit 20. Of course, the dimensions of the outer discs 22, 23, the inner rotary disc 24, the grooves 34, 35, 41, 42 in each disc, and the feed openings 52 may be varied according to the specific grinding needs and the particular slurry material to be ground.

Once the slurry solution is transferred into grooves 34, 35, 41 and 42, the slurry solution is transported outwardly within the grooves 34, 35, 41 and 42, through centrifugal force created by the rotating disc 24. As the slurry solution is transported along the tapered grooves 34, 35, 41 and 42, the particles in the slurry solution are continuously ground and disintegrated at least until they reach a maximum size which is defined by the distance between the major surfaces 43, 44 of the rotary disc 24 and each respectively opposed inner surface 26, 27 of the outer discs 22, 23. This maximum size results because each of the grooves 34, 35, 41 and 42 tapers up to the respective surfaces 26, 27, 43 and 44 a short distance inside of the peripheral edges of these surfaces 26, 27, 43 and 44. Thus, small surface areas **26*a*, 27*a*, 43*a* and 44*a* are left outside the outlet ends 38, 39, 48 and 49 of the respective grooves 34, 35, 41 and 42. The distance between surfaces 26 and 44 as well as the distance between surfaces 27 and 43 therefore essentially govern the maximum output particle size. The maximum output particle size may therefore be controlled by varying these distances through specific dimensioning of the apparatus. The distance between surfaces 27 and 43 and surfaces 26 and 44 may each be, for example, 0.010" and the grinding unit 20 will still produce particles on the order of several microns or less to achieve extremely find grinding of particles in a slurry solution. Thus, it will be appreciated that the plates or discs 22, 23, 24 need not be spaced apart by 5 microns to obtain particles of 5 microns, for example. The combined effects of the high speed rotation of at least one disc, the shearing effects of the tapered grooves, and the high speed collisions between particles cause the particles to be disintegrated to a size smaller than the spacing between the flat surfaces 26, 27, 43, 44 of the respective discs 22, 23, 24**.

Separate cooling means are generally not necessary since the slurry solution itself acts as a lubricant and coolant as it flows through the grinding unit 20. Of course, a cooling jacket may be used around the grinding unit 20 if necessitated by a particular grinding operation.

When the slurry solution reaches the outer peripheral edge of the rotary disc 24, the slurry solution is transferred along the inner edge of flange portion 25 of disc 22 to the outlet port 31 by notches 45 in the rotary disc 24. In this regard, the notches 45 in the rotary disc 24 provide a pumping action, similar to a centrifugal pump, to continuously feed slurry material through the outlet port 31. To provide a continuous grinding or disintegration action, the outlet port 31 may be connected by suitable fluid lines and fittings to a slurry supply and back to the inlet port 30 such that the slurry solution in the supply is continuously recirculated through the grinding unit 20. Alternatively, the inlet port 30 may be connected to a slurry supply and the outlet port 31 may be connected to a separate receiving tank.

The operation of the in-tank grinding apparatus 110 shown in FIG. 4 is very similar to the operation of the in-line grinding apparatus 10 described above with reference to FIG. 2. The only significant difference is that the grinding unit 120 is placed into a batch of slurry material 126 such that slurry material is constantly forced into the inlet 130 of the grinding unit 120 by atmospheric pressure exerted against the top surface of the slurry material 126. The slurry material travels into the grinding unit 120 and the particles in the slurry are ground or disintegrated in a manner identical to that described above with reference to FIG. 2. However, rather than being transferred out of the grinding unit 120 through a single outlet port, the slurry material preferably exits the grinding unit 120 through several outlets 131. The slurry material 126 contained in the tank is constantly recirculated through the grinding unit 120 until substantially all of the slurry material 126 in the tank has passed through the grinding unit 120.

Although preferred embodiments of the present invention have been shown and described above, one of ordinary skill will readily recognize numerous modifications thereto. For example, although the grinding units are shown to include a rotary disc having grooves on both sides thereof and outer plates each having inner grooves opposing the grooves in the rotary disc, the grinding unit could readily be modified into a two disc system having one series of grooves on each disc in opposed relation. Furthermore, the grinding unit may be designed with suitable multiple drive shaft and/or gear systems such that more than one of the discs are rotated at one time. For example, the grinding unit could be design using conventional drive mechanisms such that adjacent discs rotate in opposite directions so as to increase the difference in their relative speeds and thereby increase the resulting particle disintegration. In addition, the design of the grooves in the various discs may be varied by, for example, extending their lengths by forming them in patterns other than the radially extending patterns shown and described herein. One alternative is to form them shaped as curves extending from their inlet ends to their outlet ends. The grooves may be tapered in width as well as depth from an inlet end to an outlet end thereof, for example, such that they are wider at the inlet end. For coarser grinding applications, the grooves may be left untapered in depth. Finally, the grooves may have concavely shaped bottom surfaces as opposed to flat bottom surfaces as shown. This would, for example, prevent buildup of slurry material in the grooves.

Other modifications will become readily apparent to the artisan of ordinary skill and applicant intends to be bound only by the scope of the appended claims.

I claim:

1. Wet grinding apparatus comprising:

a housing, first and second opposed flat grinding faces disposed within said housing, said second face being contained on a rotatable disc mounted within said housing, a plurality of grooves in each of said first and second opposed grinding faces, said grooves in said opposed flat grinding faces each including an inlet end disposed proximate a central portion of the corresponding opposed grinding face and an outlet end at an outer portion of the corresponding opposed grinding face, each groove decreasing in depth from said inlet end to said outlet end, and said outlet end being defined by a radial position at which a bottom surface of a respective groove intersects with the corresponding flat grinding face, an inlet to said housing for introducing a slurry solution containing particles into the inlet ends of said grooves of said first and second opposed grinding faces, an outlet from said housing for allowing said slurry solution to exit said grooves, and a drive connected to said rotatable disc for rotating said rotatable disc while said slurry solution travels from said inlet to said outlet.

2. The wet grinding apparatus of claim 1 wherein said first and second opposed grinding faces are contained on first and second discs, said second disc comprising said rotatable disc and the apparatus further comprising a third disc, wherein said first disc and said third disc define outer discs having a plurality of grooves in inner faces thereof and said second disc defines an inner disc disposed between said first and third discs, said drive means rotates said second disc and said second disc includes grooves in both faces thereof such that the grooves in one face of said second disc intermittently register with the grooves in the inner face of said first disc and the grooves in the other face of said second disc intermittently register with the grooves in the inner face of said third disc as said second disc is rotated by said drive means.

3. The wet grinding apparatus of claim 2 wherein said first and third discs are stationary.

4. The wet grinding apparatus of claim 3 wherein said grooves in said first, second and third discs extend radially outwardly from the inlet end proximate to the center of each disc to the outlet end proximate the periphery of each disc.

5. The wet grinding apparatus of claim 4 wherein said grooves in said first, second and third discs end short of the peripheral edge of each disc, whereby the maximum particle size capable of passing between the first and second discs and the second and third discs, respectively, is defined by the distance between opposed flat grinding faces of the first and second discs and the second and third discs, respectively.

6. The wet grinding apparatus of claim 5 wherein the distance between the opposed faces of the first and second discs and the opposed faces of the second and third discs, respectively, is approximately 0.010 inches.

7. The wet grinding apparatus of claim 6 wherein said second disc includes an outer peripheral surface having a plurality of notches therein for carrying slurry solution to said outlet means.

8. The wet grinding apparatus of claim 7 wherein one of said first and said third discs includes an outer flange portion which is attached to the other of said first and said third discs, whereby said first and third discs define said housing for said second disc.

9. The wet grinding apparatus of claim 8 wherein said inlet includes a central inlet port in one of said first and said third discs and the other of said first and said third discs includes a central bore for receiving said drive, and said drive is a rotatable drive shaft attached to said second disc.

10. The wet grinding apparatus of claim 9 wherein said outlet comprises a plurality of apertures in said outer flange portion.

11. The wet grinding apparatus of claim 10 wherein said outlet comprises an outlet port in said outer flange portion and said inlet and outlet ports each further include means for connecting said inlet and outlet ports to fluid line means for recirculating slurry solution from said outlet port to said inlet port.

12. The wet grinding apparatus of claim 11 further comprising said fluid line means connected between said inlet port and said outlet port.

13. The wet grinding apparatus of claim 1 further comprising:

an annular pattern of feed openings having a diameter corresponding to a maximum particle size and located about a center of said rotatable disc, each feed opening having one end communicating with the inlet to said housing and another end opening to the inlet end of one groove in said rotatable disc, wherein the diameter of each feed opening is approximately equal to a maximum width of the inlet end of a corresponding groove in said rotatable disc.

14. Wet grinding apparatus comprising:

a housing, first and second pairs of opposed grinding faces disposed within said housing, wherein one grinding face of each pair of opposed grinding faces is contained on a rotatable disc mounted within said housing, a plurality of grooves in each opposed grinding face, an inlet to said housing for introducing a slurry solution containing particles into said grooves of said first and second pairs of opposed grinding faces, an outlet through a periphery of said housing for allowing said slurry solution to exit said grooves in said first and second pairs of opposed grinding faces, a drive connected to said rotatable disc for rotating said rotatable disc while said slurry solution travels from said inlet to said outlet, and a plurality of notches in a radially outwardly facing peripheral surface of said rotatable disc, said notches facing a radially inwardly facing peripheral wall surface of said housing and adapted to carry ground slurry solution about the periphery of said housing to said outlet as said rotatable disc rotates.

15. The wet grinding apparatus of claim 14 wherein one grinding face of each pair of opposed grinding faces is contained on respective stationary discs.

16. The wet grinding apparatus of claim 15 wherein said grooves in said rotatable disc and said stationary discs extend radially outwardly from an inlet end proximate to the center of each disc to an outlet end proximate the periphery of each disc.

17. The wet grinding apparatus of claim 16 wherein said grooves taper in depth from an inlet end proximate the center of each disc to an outlet end proximate the periphery of each disc, wherein said grooves are deeper at said inlet end than at said outlet end.

18. The wet grinding apparatus of claim 14 wherein one of said stationery discs include an outer flange portion which is attached to the other of said stationary discs, whereby said stationary discs define a housing for said rotatable disc and said housing includes said outlet for allowing said slurry solution to exit said grooves.

19. The wet grinding apparatus of claim 18 wherein said outlet comprises a plurality of apertures in said outer flange portion.

20. The wet grinding apparatus of claim 18 wherein said outlet comprises an outlet port in said outer flange portion and said inlet and said outlet port each further include means for connecting said inlet and said outlet port to fluid line means for recirculating slurry solution from said outlet port to said inlet.

21. The wet grinding apparatus of claim 20 further comprising said fluid line means connected between said inlet and said outlet port.

22. The wet grinding apparatus of claim 14 wherein one of said stationary discs includes a central inlet port which defines said inlet and the other of said stationary discs includes a central bore for receiving said drive, and said drive is a rotatable drive shaft attached to said rotatable disc.

23. The wet grinding apparatus of claim 14 wherein said inlet includes a series of radially spaced apertures centrally located in said second disc, each radially spaced aperture opening to an inlet end of a groove on each face of said rotatable disc.

24. Wet grinding apparatus comprising:

a housing;

first and second pairs of opposed grinding faces disposed within said housing, wherein one grinding face of each pair of opposed grinding faces is contained on a rotatable disc mounted within said housing, a plurality of tapered grooves in each pair of opposed grinding faces, said grooves tapering in depth from an inlet end proximate the center of said rotatable disc to an outlet end proximate the periphery of said rotatable disc, said grooves being deeper at said inlet end than at said outlet end, inlet means for introducing a slurry solution containing particles into the inlet end of said grooves of said first and second pairs of opposed grinding faces, an outlet through a periphery of said housing for allowing said slurry solution to exit said grooves in said first and second pairs of opposed grinding faces, a drive connected to said rotatable disc for rotating said rotatable disc while said slurry solution travels from said inlet ends to said outlet ends of each groove, an annular pattern of feed openings having a diameter corresponding to a maximum particle size and located about a center of said rotatable disc, each feed opening having one end communicating with the inlet to said housing and another end opening directly to the inlet end of one groove in said rotatable disc, wherein the diameter of each feed opening is approximately equal to a maximum width of the inlet end of a corresponding groove in said rotatable disc, and a plurality of notches in a radially outwardly facing peripheral surface of said rotatable disc, said notches facing a radially inwardly facing peripheral wall surface of said housing and adapted to carry ground slurry solution about the periphery of said housing to said outlet as said rotatable disc rotates.

25. The wet grinding apparatus of claim 24 wherein said grooves taper up to said grinding faces at a point short of the peripheral edge of each disc, whereby the maximum particle size capable of passing between said first pair of opposed faces is defined by the respective distances between said first and second pairs of opposed grinding faces.

26. The wet grinding apparatus of claim 25 wherein the respective distances between said first and second pairs of opposed grinding faces is approximately 0.010 inches.

27. A method of reducing the size of particles contained in a slurry solution comprising:

introducing said slurry solution into inner ends of a plurality of spaced, outwardly extending grooves in adjacent major faces of a pair of discs through an annular pattern of feed holes in one of said discs which communicate directly with the inner ends of respective grooves in said one disc and which are formed with a diameter approximately equal to a maximum width of a respective groove at said inner end, and rotating at least one of said discs to simultaneously reduce the size of said particles in said slurry solution while transferring said slurry solution from the inner ends to outer ends of said grooves.

28. The method of claim 27 wherein said at least one disc is directly coupled to a drive shaft which is rotated at a speed of at least 1000 rpm.

29. The method of claim 27 further comprising the step of:

recirculating said slurry solution from the outer ends of said grooves to the inner ends of said grooves.

30. A method of reducing the size of particles contained in a slurry solution comprising:

introducing said slurry solution into inner ends of a plurality of spaced, outwardly extending grooves in adjacent major faces of at least two adjacent discs disposed within a housing, rotating one of said discs to simultaneously reduce the size of said particles in said slurry solution while transferring said slurry solution from the inner ends to outer ends of said grooves, discharging said slurry solution from the outer ends of said grooves into notches contained in a radially outwardly facing peripheral surface of said one disc, and carrying said slurry solution within said notches during rotation of said one disc to an outlet in said housing.

31. The method of claim 30 wherein said one disc is directly coupled to a drive shaft which is rotated at a speed of at least 1000 rpm.

32. The method of claim 30 further comprising the step of:

recirculating said slurry solution from the outer ends of said grooves to the inner ends of said grooves.

33. Wet grinding apparatus comprising:

a housing, first and second opposed grinding faces disposed within said housing, said second face being contained on a rotatable disc mounted within said housing, a plurality grooves in each first and second opposed grinding faces, said grooves in said opposed grinding faces each including an inlet end having a width and disposed proximate a central portion of said opposed grinding faces and an outlet end at outer portions of said opposed grinding faces, each groove decreasing in depth from said inlet end to said outlet end, an inlet to said housing for introducing a slurry solution containing particles into the inlet ends of said grooves of said first and second opposed grinding faces, an outlet from said housing for allowing said slurry solution to exit said grooves, a drive connected to said rotatable disc for rotating said rotatable disc while said slurry solution travels from said inlet to said outlet, and an annular pattern of feed openings having a diameter corresponding to a maximum particle size and located about a center of said rotatable disc, each feed opening having one end communicating with the inlet to said housing and another end opening to the inlet end of one groove in said rotatable disc, wherein the diameter of each feed opening is not greater than a maximum width of the inlet end of a corresponding groove in said rotatable disc.

* * * * *